US008393622B2

(12) United States Patent
Choi et al.

(10) Patent No.: US 8,393,622 B2
(45) **Date of Patent: *Mar. 12, 2013**

(54) GATE SYSTEM DIVERTING SHEETS INTO MULTI-WAYS

(75) Inventors: Injae Choi, Webster, NY (US); Barry Paul Mandel, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/275,435

(22) Filed: Oct. 18, 2011

(65) Prior Publication Data

US 2012/0032389 A1 Feb. 9, 2012

Related U.S. Application Data

(63) Continuation of application No. 12/582,194, filed on Oct. 20, 2009, now Pat. No. 8,006,284.

(51) Int. Cl.
*B65H 39/10* (2006.01)

(52) U.S. Cl. ..... 271/303; 271/302; 271/301

(58) Field of Classification Search ..... 271/264, 271/302, 303, 301

See application file for complete search history.

(56) References Cited

U.S. PATENT DOCUMENTS

| | | | | |
|---|---|---|---|---|
| 5,794,931 | A | 8/1998 | Heilman et al. | |
| 6,176,485 | B1 | 1/2001 | Wingate | |
| 6,595,518 | B2 | 7/2003 | Dobrindt | |
| 6,644,655 | B2 * | 11/2003 | Wurschum | 271/225 |
| 6,923,439 | B2 | 8/2005 | Hashimoto | |
| 6,988,729 | B2 | 1/2006 | Tamura et al. | |
| 2003/0234487 | A1 | 12/2003 | Tamura et al. | |
| 2004/0150158 | A1 | 8/2004 | Biegelsen et al. | |

* cited by examiner

*Primary Examiner* — Kaitlin Joerger
(74) *Attorney, Agent, or Firm* — Hoffmann & Baron, LLP

(57) ABSTRACT

According to aspects illustrated herein, there are provided systems for conveying a sheet article into an intended pathway. The multi-way gate system for diverting sheets into multiple pathways in a sheet conveying device includes at least three pathways for directing the sheet from the sheet conveying member in a particular direction. A single gate plate is between the sheet conveying member and the pathways. The single gate plate is rotatable about a single axis to direct the sheet exiting the sheet conveying member toward one of the pathways.

16 Claims, 2 Drawing Sheets

GATE SYSTEM DIVERTING SHEETS INTO MULTI-WAYS

CROSS-REFERENCE TO RELATED APPLICATION

This application claims the benefit of U.S. application Ser. No. 12/582,194, filed on Oct. 20, 2009, the contents of which are incorporated by reference herein.

FIELD OF THE INVENTION

This disclosure generally relates to a guide apparatus for selectively guiding sheet articles into a multiple conveying path. Specifically, this disclosure relates to a single gate system for guiding sheet articles through multiple pathways in any type of sheet conveying device including printing and nonprinting devices.

BACKGROUND OF THE INVENTION

Many sheet conveying devices including printing and nonprinting devices include a pathway that branches off in a plurality of directions. The mechanism that assists the sheet to the intended pathway is path selectors which are arranged in series along the path for steering a sheet. The sheet is directed into one of two-pathways by the two-path selector. After the sheet enters the intended pathway, the sheet is again directed into one of the two new pathways by another two-path selector. This pathway selection process continues in series until the sheet reaches the final intended pathway and proceeds as needed through the rest of the sheet conveying device. However, the problem with this configuration is that the two-path selectors positioned one after the other increase the width of the conveying device because the path selectors are arranged in series one after the other.

The two-path selectors may also be arranged in parallel. The two parallel path selectors are rotated simultaneously with each other. This, however, gives rise to a problem that the path selectors increase the number of actuators at a path selector, which may lower the reliability of the system and increase the shutdown rate due to paper jams. Additionally, this arrangement has a limitation on extending to more than three pathways.

There is a need for a multi-way gate system for diverting sheets into more than two paths of a sheet conveying device including a printing device or nonprinting device. While prior methods for selecting one of three pathways exist, there is a need for a single gate system that does not lower the reliability of the unit, yet provides for accurate distribution of the paper articles and limited time consumption during the path selecting process.

SUMMARY OF THE INVENTION

According to aspects illustrated herein, there is provided a multi-way gate system for diverting sheets into multiple pathways in a sheet conveying device. The multi-way gate system includes a sheet conveying member, at least three pathways and a single gate plate. The sheet conveying member conveys a sheet through the device. The at least three pathways direct the sheet from the sheet conveying member in a particular direction. The single gate plate including a first surface and a second surface is located between the sheet conveying member and the at least three pathways. The single gate plate is rotatable about a single axis to direct the sheet exiting the sheet conveying member towards one of the at least three pathways.

According to another aspect illustrated herein, there is provided a multi-way gate system for diverting sheets into multiple pathways in a sheet conveying device including a sheet conveying member, at least three pathways, a single gate plate and a hinged baffle. The sheet conveying member conveys a sheet. The at least three pathways directs the sheet from the sheet conveying member in a particular direction. The single gate plate is located between the sheet conveying member and the at least three pathways. The single gate plate is rotatable about a single axis to direct the sheet exiting the sheet conveying member towards one of the at least three pathways. The hinged baffle is located at the first surface side of the single gate plate. The hinged baffle is pivotable upon an axis to biased contact of said hinged baffle with said first gate surface.

According to a further aspect illustrated herein, there is provide a multi-way gate system for diverting sheets into multiple pathways in a sheet conveying device including a sheet conveying member, four pathways, a single gate plate, a first hinged baffle and a second hinged baffle. The sheet conveying member conveys a sheet. The four pathways include a first pathway, a second pathway, a third pathway and a fourth pathway. The four pathways direct the sheet from the sheet conveying member in a particular direction. The single gate plate has a first surface and second surface and the single gate plate located between the sheet conveying member and the four pathways. The single gate plate is rotatable about a single axis to direct the sheet exiting the sheet conveying member into one of the four pathways. The single gate plate is located between the first hinged baffle and the second hinged baffle. The first hinged baffle is located at the first surface side of the single gate plate and the first hinged baffle is pivotable upon an axis. The first hinged baffle is spaced apart from the first surface of the gate plate for directing the sheet into the first pathway or the second pathway. The second hinged baffle is spaced apart from the second surface of the gate plate to divert the sheet into either of the third pathway or the fourth pathway. The second hinged baffle is pivotable upon an axis.

Additional features and advantages will be readily apparent from the following detailed description, the accompanying drawings and the claims. It is to be understood, however, that the drawings are designed as an illustration only and not as a definition of the limits of the disclosure.

DETAILED DESCRIPTION OF THE PREFERRED EMBODIMENT

The systems disclosed herein use a single gate to guide a paper article through a sheet conveying system into one of at least three different pathways.

As used herein, the phrase "sheet conveying device" encompasses any apparatus, such as a digital copier, a bookmaking machine, a facsimile machine, and a multi-function machine, which performs an outputting function for any purpose. The sheet conveying device includes printing and non-printing devices. Examples of marking technologies include xerographic, inkjet, and offset marking.

As used herein, the phrase "sheet" encompasses, for example, one or more of a usually flimsy physical sheet of paper, heavy media paper, coated papers, transparencies, parchment, film, fabric, plastic, or other suitable physical print media substrate on which information can be reproduced.

As used herein, the phrase "path" or "pathway" encompasses any apparatus for separating and/or conveying one or more sheets into a substrate conveyance path inside a printing device.

As used herein the phrase "baffle" refers to a device configured to guide a substrate, such as a sheet, along a path. The baffle used herein includes moving baffles and non moving baffles. The moving baffles may be independently pivotable or connected to and pivotable with the gate. Additionally, it is contemplated that the baffle could be a non moving part that guides the sheet into the intended path, or pathway formed by members. The baffle could be made of plates, flexible or non flexible extensions, stand alone protrusions or knobs, wires, plastic moldings and any other devices that are configured to guide a substrate.

Figure 1:
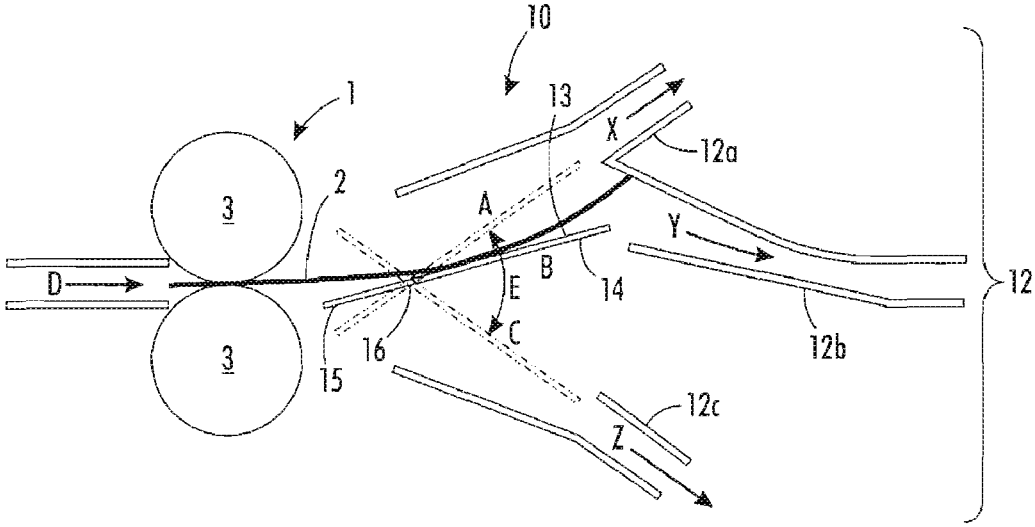
FIG. 1 shows a three-way gate system of a sheet conveying device.

FIG. 1 provides a three-way gate system 10 for diverting or guiding a sheet 2 into one of three pathways 12 (12*a*,12*b*,12*c*) in a sheet conveying device 1. A sheet 2 is fed from rolls 3 towards the gate plate 14 along the path direction D. The gate plate 14 is rotatable about a single gate plate axis 16. The gate plate 14 is an elongated planar plate with a first surface 13 and a second surface 15. The gate plate 14 rotates to align one of its surfaces (13, 15) with one of the three pathways 12. The sheet 2 is moved by the rolls 3 onto and across the gate plate 14 in the direction of D. The sheet is guided by the gate plate 14 into the aligned pathway in the path direction of X, Y or Z. FIG. 1 shows the various orientations of gate plate 14 to direct the sheet 2 into one of the three pathways (12*a*, 12*b*, 12*c*). The gate plate 14 has a rotation angle range E which allows the gate plate 14 to align with any of the three pathways. The gate plate 14 is rotated about the axis 16 to orient the gate plate 14 into position A. Position A of the gate plate 14 directs or guides the sheet 2 along the first surface 13 of the gate plate 14 and into the first pathway 12*a* in the direction of X. Similarly, gate plate 14 is rotated about the axis 16 to orient the gate plate 14 into position B. Position B of the gate plate 14 directs or guides the sheet 2 along the first surface 13 of the gate plate 14 and into the second pathway 12*b* in the direction of Y. Further, when gate plate 14 is rotated about the axis 16 to orient the gate plate 14 into position C, position C of the gate plate 14 directs or guides the sheet 2 along the second surface 15 of the gate plate 14 and into the third pathway 12*c* in the direction of Z. The actuation of the gate plate 14 about the axis 16 may be achieved by a motor, such as a stepper motor.

Figure 2:
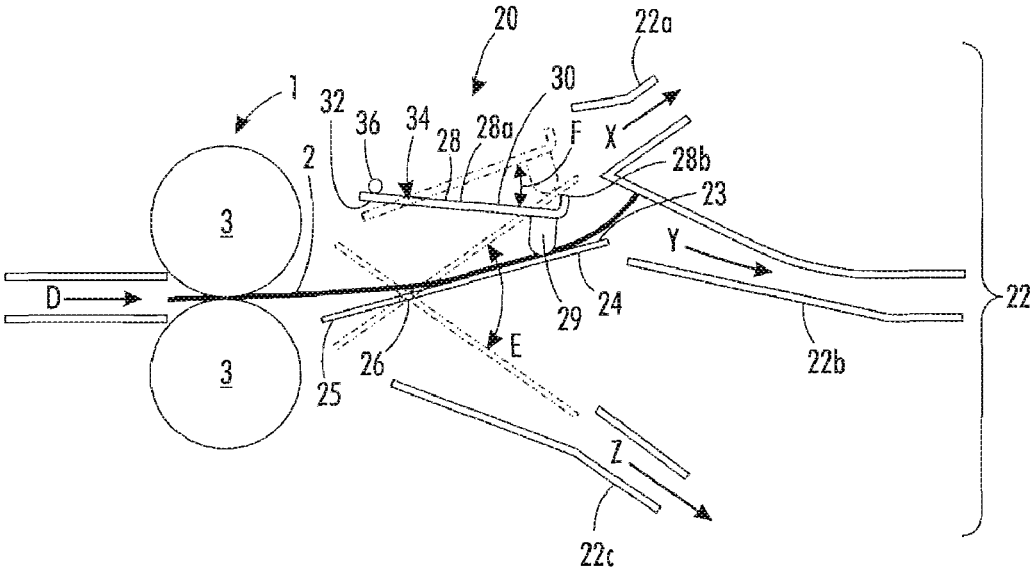
FIG. 2 shows a three-way gate system of a sheet conveying device including a hinged baffle.

FIG. 2 provides a three-way gate system 20 for diverting or guiding a sheet 2 into one of three pathways 22 (22*a*,22*b*,22*c*) in a sheet conveying device 1. The three-way gate system 20 is similar to the three-way gate system 10 including a gate plate 14. The three-way gate system 20 includes a gate plate 24 and a hinged baffle 28. The hinged baffle 28 is positioned at the first surface 23 side of the gate plate 24. Various baffle designs are available to provide the spacing as required herein. FIG. 2 shows the hinged baffle 28 has an L-shaped bar, rod or plate including an elongated portion 28*a* and a shorter portion 28*b* extending perpendicularly from the elongated portion 28*a*. The hinged baffle 28 includes a first surface 30 and a second surface 32. FIG. 2 shows a protrusion 29 extends from the second surface 32 of the elongated portion 28*a* in the opposing direction from the shorter portion 28*b*. The hinged baffle 28 prevents a severely curled sheet intended to enter into the middle pathway 22*b* from diverting into the pathway 22*a*. Additionally, the hinged baffle 28 prevents paper jamming that may occur if the paper is caught between the two pathways (22*a*, 22*b*). The hinged baffle 28 is rotatable about a baffle axis 34. The hinged baffle 28 has a rotation angle range F which allows the hinged baffle 28 to move from the first pathway 22*a* to the second pathway 22*b*. The hinged baffle 28 is limited in rotation due to the stop 36 located at the far end of the hinged baffle 28 at the opposite end of the protrusion 29. The stop 36 limits the rotation of the protrusion 29 end of the hinged baffle 28 towards the gate plate 24. The hinged baffle 28 is directed to rotate the angle F by contact with the gate plate 24, as the gate plate 24 guides the hinged baffle 28 to the first pathway 22*a* or the second pathway 22*b*, and the stop 36 limits the movement towards the gate plate 24. The limited range of movement of the hinged baffle 28 prevents the hinged baffle 28 from interfering with the gate plate 24, or jamming the gate plate 24. The contact of the hinged baffle 28 with the gate plate 24 is maintained by a torsion spring or by the hinged baffle's weight with gravity acting downward in the configuration as shown in FIG. 2. The torsion spring may be installed around the center of the baffle axis 34.

FIG. 2 shows the sheet 2 is fed from rolls 3 towards the gate plate 24 along the path direction D. The gate plate 24 is rotatable about a single gate plate axis 26. The gate plate 24 is an elongated planar plate with a first surface 23 and a second surface 25. The gate plate 24 rotates to align one of its surfaces (23, 25) with one of the three pathways 22. The sheet 2 is moved by the rolls 3 onto and across the gate plate 24 in the direction of D. The sheet is guided by the gate plate 24 into the aligned pathway in the path direction of X, Y or Z. FIG. 2 shows the various orientations of gate plate 24 to direct the sheet 2 into one of the three pathways (22*a*, 22*b*, 22*c*). The gate plate 24 has a rotation angle range E which allows the gate plate 24 to align with any of the three pathways. The gate plate 24 is rotated about the axis 26 to orient the gate plate 24 in alignment with first pathway 22*a*. The hinged baffle 28 contacts the first surface 23 of the gate plate 24. The sheet 2 slides between the first surface 23 and the hinged baffle 28 and the sheet is guided into the first pathway 22*a* in the direction of X. Similarly, gate plate 24 is rotated about the axis 26 to orient the gate plate 24 in alignment with second pathway 22*b*. The hinged baffle 28 contacts the first surface 23 of the gate plate 24. The sheet 2 slides between the first surface 23 and the hinged baffle 28 and the sheet is guided into the second pathway 22*b* in the direction of Y. Further, when gate plate 24 is rotated about the axis 26 to orient the gate plate 24 in alignment with third pathway 22*c*, the gate plate 24 directs or guides the sheet 2 along the second surface 25 of the gate plate 24 and into the third pathway 22*c* in the direction of Z. The actuation of the gate plate 24 about the axis 26 may be achieved by a motor, such as a stepper motor.

Figure 3:
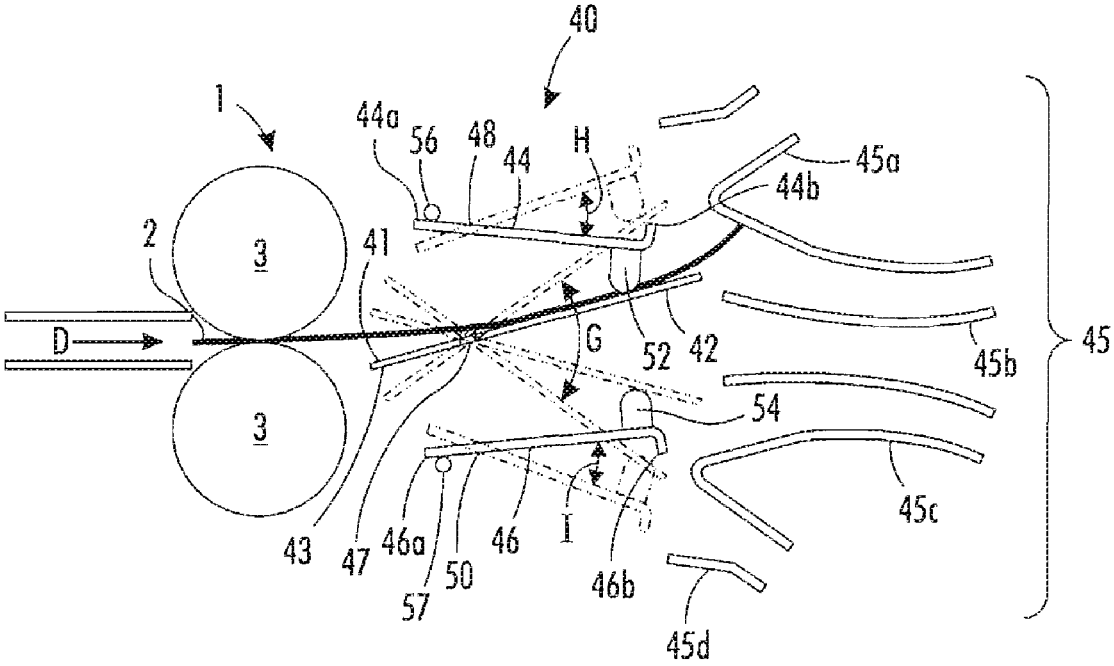
FIG. 3 shows a four-way gate system of a sheet conveying device.

FIG. 3 provides a four-way gate system 40 that is similar to the three-way gate system 20 of FIG. 2 including a gate plate and hinged baffle. The four-way gate system 40 is used for directing or guiding a sheet article to one of the four pathways 45 (45*a*, 45*b*, 45*c*, 45*d*). The four-way gate system 40 includes a gate plate 42 sandwiched between two hinged baffles 44, 46. The gate plate 42 has a rotation angle range G which allows the gate plate to move in alignment with the four pathways 45. The hinged baffles 44, 46 include first hinged baffle 44 and second hinged baffle 46. The hinged baffles 44, 46 are similar to the hinged baffle 28 of FIG. 2. The hinged baffles 44, 46 are rotatable about baffle axes 48, 50, respectively. Various baffle designs are available to provide the spacing as required herein. FIG. 3 shows each hinged baffle 44, 46 as having an L-shaped bar, rod or plate including an elongated portion 44*a*, 46*a* and a shorter portion 44*b*, 46*b* extending perpendicularly from the elongated portion 44*a* and 46*a*. The hinged baffles 44, 46 include a first surface and a second surface with a protrusion 52, 54 respectively, extending from each surface of the elongated portion in the opposing direction from the shorter portion.

The first hinged baffle 44 is limited in rotation due to the stop 56 located at the far end of the first hinged baffle 44 at the opposite end of the protrusion 52. The first hinged baffle 44 has a rotation angle range H which allows for movement and alignment between the first pathway 45*a* and the second pathway 45*b*. The first hinged baffle 44 is positioned at the first surface 41 side of the gate plate 42. The first hinged baffle 44 prevents a severely curled sheet intended to enter into the second pathway 45*b* from diverting into the first pathway 45*a*. Additionally, the hinged top baffle 44 prevents paper jamming that may occur if the paper is caught between the two pathways (45*a*, 45*b*). The stop 56 limits the rotation of the protrusion 52 end of the first hinged baffle 44 towards the gate plate 42. The first hinged baffle 44 is directed to move between the first pathway 45*a* and the second pathway 45*b* by contact with the gate plate 42. The limited range of movement of the first hinged baffle 44 prevents the hinged top baffle 44 from interfering with the gate plate 42, or jamming the system. The contact of the first hinged baffle 44 with the gate plate 42 is maintained by a torsion spring or by the first hinged baffle's weight with gravity acting downward in the configuration as shown in FIG. 3. The torsion spring may be installed around the center of the baffle axis 48.

The second hinged baffle 46 is positioned at the second surface 43 side of the gate plate 42. The second hinged baffle 46 prevents a severely curled sheet intended to enter into the third pathway 45*c* from diverting into the fourth pathway 45*d*. Additionally, the second hinged baffle 46 prevents paper jamming that may occur if the paper is caught between the two pathways (45*c*, 45*d*). The stop 57 limits the rotation of the protrusion 54 end of the second hinged baffle 46 towards the gate plate 42. The second hinged baffle 46 is directed to move between the third pathway 45*c* and the fourth pathway 45*d* by contact with the gate plate 42. The contact of the second hinged baffle 46 with the gate plate 42 is maintained by the gate plate 42 pushing on the second hinged baffle 46 and a torsion spring assembly setting the second hinged baffle 46 to be positioned at the resting state of alignment with the third pathway 45*c*. Force is required to move the second hinged baffle 46 against the force of the spring to the location of the fourth pathway 45*d*. The torsion spring may be installed around the center of the baffle axis 50. The second hinged baffle 46 has rotation angle range I which allows for alignment between the third pathway 45*c* and the fourth pathway 45*d*.

FIG. 3 shows the sheet 2 is fed from rolls 3 towards the gate plate 42 along the path direction D. The gate plate 42 is rotatable about a single gate plate axis 47. The gate plate 42 is an elongated planar plate with a first surface 41 and a second surface 43. The gate plate 42 rotates to align one of its surfaces (41, 43) with one of the four pathways 45. The sheet 2 is moved by the rolls 3 onto and across the gate plate 42 in the direction of D. The sheet is guided by the gate plate 42 into the aligned pathway. FIG. 3 shows the various orientations of gate plate 42 to direct the sheet 2 into one of the four pathways (45*a*, 45*b*, 45*c*, and 45*d*). The gate plate 42 has a rotation angle range G which allows the gate plate 42 to align with any of the four pathways. For example, the gate plate 42 is rotated about the axis 47 to orient the gate plate 45 in alignment with first pathway 45*a*. The first hinged baffle 44 contacts the first surface 41 of the gate plate 42. The sheet 2 slides between the first surface 41 and the first hinged baffle 44 and the sheet is guided into the first pathway 45*a*. Similarly, gate plate 42 is rotated about the axis 47 to orient the gate plate 42 in alignment with second pathway 45*b*. The first hinged baffle 44 contacts the first surface 41 of the gate plate 42. The sheet 2 slides between the first surface 41 and the first hinged baffle 44 and the sheet is guided into the second pathway 22*b*. Further, when gate plate 42 is rotated about the axis 47 to orient the gate plate 42 in alignment with the third pathway 45*c*, the second hinged baffle 46 contacts the second surface 43 of the gate plate 42. The gate plate 42 and second hinged baffle 46 directs or guides the sheet 2 along the second surface 43 of the gate plate 42 and into the third pathway 45*c*. Furthermore, when gate plate 42 is rotated about the axis 47 to orient the gate plate 42 in alignment with the fourth pathway 45*d*, the second hinged baffle 46 contacts the second surface 43 of the gate plate 42. The gate plate 42 and second hinged baffle 46 directs or guides the sheet 2 along the second surface 43 of the gate plate 42 and into the fourth pathway 45*d*. The actuation of the gate plate 42 about the axis 47 may be achieved by a motor, such as a stepper motor.

Having described the aspects herein, it should now be appreciated that variations may be made thereto without departing from the contemplated scope. Accordingly, the aspects described herein are deemed illustrative rather than limiting, the true scope is set forth in the claims appended hereto.

What is claimed is:

1. A multi-way gate system for diverting sheets into multiple pathways in a sheet conveying device comprising:

a sheet conveying member for conveying a sheet;

at least three pathways for directing said sheet from said sheet conveying member in a particular direction;

a single gate plate including a first surface and a second surface, said single gate plate between said sheet conveying member and said at least three pathways, said single gate plate is rotatable about a single axis to direct said sheet exiting said sheet conveying member toward one of said at least three pathways;

a first hinged baffle located at said first surface side of said single gate plate which is biased towards and spaced apart from said single gate plate during a portion of the rotational travel of said single gate plate; and, a second hinged baffle located at said second surface side of said single gate plate which is biased towards and spaced apart from said single gate plate during a portion of the rotational travel of said single gate plate.

2. The multi-gate system of claim 1 further including a motor for actuating said single gate plate by rotating said single gate plate about said single axis wherein rotating said single gate plate directs said sheet into one of said at least three pathways.

3. The multi-gate system of claim 1 wherein said first hinged baffle is pivotable upon a first baffle single axis, said first baffle single axis allows for corresponding movement of said first hinged baffle with said single gate plate during a portion of the travel of said single gate plate, said corresponding movement prevents an curled sheet from entering an unintended pathway.

4. The multi-gate system of claim 3 further including a stop located to limit the rotation of said first hinged baffle.

5. A multi-way gate system for diverting sheets into multiple pathways in a sheet conveying device comprising:

a sheet conveying member for conveying a sheet;

at least three pathways for directing said sheet from said sheet conveying member in a particular direction;

a single gate plate including a first surface and a second surface, said single gate plate between said sheet conveying member and said at least three pathways, said single gate plate is rotatable about a single axis to direct said sheet exiting said sheet conveying member toward one of said at least three pathways, wherein said at least three pathways includes a first pathway, a second pathway, a third pathway and a fourth pathway, a first hinged baffle and a second hinged baffle, said first hinged baffle is spaced apart from said first surface of said single gate plate during a portion of its travel for directing a sheet into either said first pathway or said second pathway, said second hinged baffle is spaced apart from said second surface of said single gate plate during another portion of its travel to divert a sheet into either of said third pathway or said fourth pathway.

6. The multi-gate system of claim 5 wherein said first hinged baffle and said second hinged baffle are biased towards and spaced apart from said single gate plate during portions of the rotational travel of said single gate plate.

7. The multi-gate system of claim 6 wherein each of said first hinged baffle and said second hinged baffle includes a single pivot point.

8. The multi-gate system of claim 1 wherein said single gate plate includes a first end, a second end and a plate extending therebetween, said single axis is on said plate and located closer to said first end and said sheet conveying member.

9. The multi-gate system of claim 6 wherein said first hinged baffle includes an axis, said axis is located closer to one end of said first hinged baffle than the other end.

10. The multi-gate system of claim 6 wherein said second hinged baffle includes an axis, said axis is located closer to one end of said second hinged baffle than the other end.

11. The multi-gate system of claim 9 wherein said second hinged baffle includes an axis, said axis is located closer to one end of said second hinged baffle than the other end.

12. The multi-gate system of claim 5 further including a motor for actuating said single gate plate by rotating said single gate plate about said axis wherein rotating said single gate plate directs said sheet into one of said at least three pathways.

13. The multi-gate system of claim 5 further including a stop located to limit the rotation of said first hinged baffle.

14. The multi-gate system of claim 5 wherein said single gate plate includes a first end, a second end and a plate extending therebetween, said single axis is on said plate and located closer to said first end and said sheet conveying member.

15. The multi-gate system of claim 5 wherein said first hinged baffle includes an axis, said axis is located closer to one end of said first hinged baffle than the other end.

16. The multi-gate system of claim 5 wherein said second hinged baffle includes an axis, said axis is located closer to one end of said second hinged baffle than the other end.

* * * * *